United States Patent [19]

Brunet

[11] Patent Number: 4,989,763

[45] Date of Patent: Feb. 5, 1991

[54] PUSHBUTTON FOR A SPRAY DEVICE ARRANGED TO MIX A PREDETERMINED QUANTITY OF A SECONDARY SUBSTANCE IN THE EMISSION OF A MAIN SUSTANCE

[75] Inventor: Michel Brunet, Sainte Colombe La Commanderie, France

[73] Assignee: Valois, Le Neubourg, France

[21] Appl. No.: 301,790

[22] Filed: Jan. 26, 1989

[30] Foreign Application Priority Data

Jan. 28, 1988 [FR] France ..... 88 00970

[51] Int. Cl.[5] ..... B65D 83/14

[52] U.S. Cl. ..... 222/635; 222/80; 239/309; 239/340; 406/117; 406/145; 604/58; 604/148

[58] Field of Search ..... 222/80–83, 222/630, 635–637, 133, 144.5, 145, 394, 399, 402.1, 402.2; 239/309, 340, 337; 406/38, 117, 145, 146; 604/24, 58, 200, 244, 201, 140

[56] References Cited

U.S. PATENT DOCUMENTS

| | | | |
|---|---|---|---|
| 2,747,770 | 5/1956 | Pereira | 239/309 X |
| 3,235,126 | 2/1966 | Shay | 222/635 X |
| 3,297,209 | 1/1967 | Pungitore | 222/635 X |
| 3,511,418 | 5/1970 | Venus, Jr. | 222/402.2 |
| 3,733,010 | 5/1973 | Riccio | 222/635 |
| 3,733,031 | 5/1973 | Marand | 222/635 X |
| 3,957,033 | 5/1976 | Winchell | 604/148 X |
| 4,249,674 | 2/1981 | Antenore | 222/635 X |
| 4,627,432 | 12/1986 | Newell et al. | 604/58 X |
| 4,811,731 | 3/1989 | Newell et al. | 604/58 X |

FOREIGN PATENT DOCUMENTS 1506698 12/1967 France .

*Primary Examiner*—Kevin P. Shaver

*Attorney, Agent, or Firm*—Sughrue, Mion, Zinn, MacPeak & Seas

[57] ABSTRACT

A pushbutton for use with a spray device for mixing a primary substance with a predetermined quantity of a secondary substance stored in such a manner as to be sheltered from the air. The pushbutton is constituted by a first piece (2) which is moveable relative to a second piece (1) containing the emission channel (11) of the pushbutton. The first piece (2) includes containers (22) advantageously disposed like rounds in the cylinder of a revolver. Each container (22) contains the desired quantity of the secondary substance and is hermetically closed by a membrane (23). When the user actuates the pushbutton, a suitable resilient piece (3) and suitable connection pieces (15, 25) ensure that the user automatically displaces the first piece (2) in such a manner that the membrane (23) of one of the containers (22) is pierced and the corresponding dose of secondary substance is delivered into the emission channel (11) so as to be sprayed out together with the main substance.

19 Claims, 1 Drawing Sheet

PUSHBUTTON FOR A SPRAY DEVICE ARRANGED TO MIX A PREDETERMINED QUANTITY OF A SECONDARY SUBSTANCE IN THE EMISSION OF A MAIN SUSTANCE

The present invention relates to the pushbutton of a spray device.

BACKGROUND OF THE INVENTION

The pushbutton of the invention is suitable for fitting onto the rod of a valve which is preferably a metering valve and which, at rest, closes the receptacle of various kinds of spray device while enabling the valve rod to be pushed in a little merely by applying finger pressure so as to allow the substance contained in the receptacle to escape (which substance is referred to below as the primary substance). In addition to stopping and starting emission of the primary substance, the pushbutton of the invention has the special feature of mixing a predetermined quantity of another substance (referred to below as the secondary substance) with the primary substance, with said mixing taking place as the primary substance is being emitted. That is why the name "exomix" has been applied to this pushbutton. It is particularly suitable for the pharmaceutical industry in which medicines to be sprayed may comprise a basic substance, perhaps a solvent, together with an additive, perhaps a solute, e.g. two liquids or a liquid and a powder, which are unsuitable for being put into contact with each other a long time in advance of being used. Utilization of such a mixing pushbutton also forms part of the present invention.

A pushbutton capable of performing such mixing exists in the prior art. It is described in French patent number FR-A-1 506 698 filed in 1966 by Marraffino. It comprises a hollow cylinder terminated by a protection which serves simultaneously as the emission channel and as the member, for actuating the valve of the spray device. A chamber is disposed around said cylinder and is in communication therewith via at least one bottom orifice, and the user may place a supply of hot water in said chamber. At rest, the water penetrates via the orifice into the bottom of the emission channel. By pressing down the hollow cylinder, the user may release, for example, shaving foam which is heated up by entraining and mixing with the water in the emission channel.

However, this prior art system is not suitable for spraying mixtures of medicines. It is often necessary for the various components of such mixtures to be protected from contact with air until the moment they are applied. There can thus be no question of placing one of these components (the "secondary" substance) in a chamber which is permanently in communication with the emission channel since the emission channel is generally open to the outside. Further, therapeutic use of such substances normally requires them to be used in carefully measured doses. Unfortunately, the pushbutton described above mixes ever smaller quantities of water in the shaving foam it emits as the supply in the chamber is used up. These two major reasons therefore require the Marraffino pushbutton to be rejected and require a new pushbutton to be developed in which the supply of the secondary substance is firstly sheltered from contact with air, and is secondly present in a known volume which is predetermined as a function of requirements.

SUMMARY OF THE INVENTION

The present invention provides a pushbutton for fitting to a spray device containing a primary substance and including an emission channel, the pushbutton comprising a first piece moveably mounted relative to a second piece containing said emission channel, said first piece of said pushbutton including containers each containing a predetermined quantity of a second substance and hermetically closed by individual membranes, said pushbutton further including resilient means and engagement means such that when said pushbutton is actuated, said first piece is caused to move relative to said second piece in such a manner as to cause the membrane of one of the said containers to be pierced and the corresponding predetermined quantity of secondary substance to be delivered into said emission channel.

This operating principle is implemented by a preferred embodiment of the present invention in which the first moving part is in the form of a revolver-type cylinder and the second part serves as a support therefor. The user thus has a spray device pushbutton which is similar in appearance to conventional pushbuttons that are not intended to perform special mixing. There is thus no need to perform special precautions for prior mixing of the substances, nor for placing a refill of the secondary substance at the outlet from the spray device. The resulting ease of use gives rise to a considerable saving in time and eliminates any risk of erroneous dosing. When used with medical preparations, this also serves as an encouragement to continue treatment even by patients who would otherwise give up easily.

BRIEF DESCRIPTION OF THE DRAWINGS

An embodiment of the invention is described by way of example with reference to the accompanying drawings, in which.

MORE DETAILED DESCRIPTION

Figure 1A:
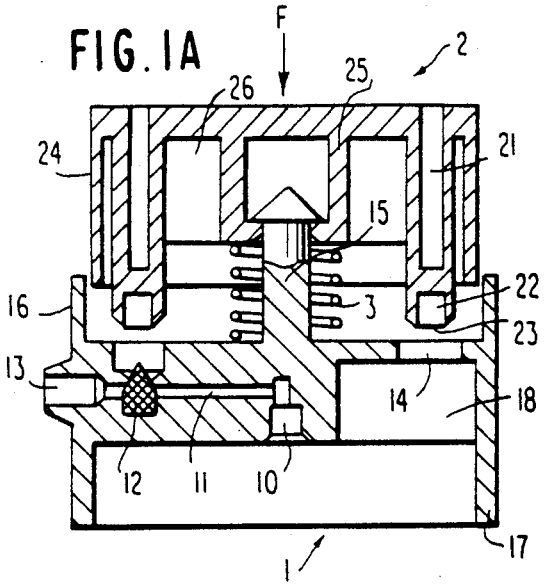
FIGS. 1A and 1B show a support in accordance with the invention in vertical section on a plane containing the axis of its emission channel, its associated revolver-type cylinder also being shown in vertical section, these two components being shown in relative positions corresponding to the pushbutton being in the rest state.
Figure 2:
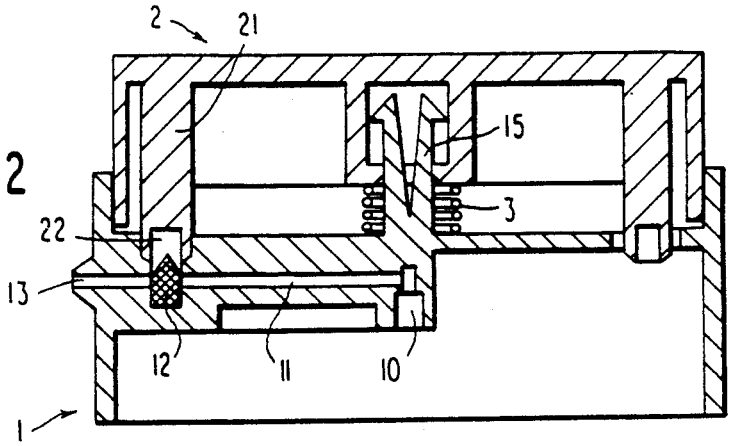
FIG. 2 is a vertical section through another embodiment of a support in accordance with the invention together with the associated cylinder, and, in this figure, these two components of the pushbutton are shown in the operating position.

The section of FIG. 1A shows a support 1 with a revolver-type cylinder 2 mounted thereon and constituting one possible embodiment of the invention. These cylindrical components have a common axis which is vertical in the figure. The bottom part of the support is shaped in a manner suitable for fitting to the valve bodies of certain types of spray device. The hollow rods of such valves (which are preferably metering valves) then engage in a recess 10. The depth of the recess and the height of a bottom skirt 17 are designed as a function of the stroke required for the valve rod to open and close the valve. The recess 10 communicates with an emission channel 11 which runs along a radius normal to the axis of the support 1. It opens out at the periphery of the support 1 via a lateral emission orifice 13 which corresponds, in this case, to a portion of increased cross-section. As can be seen in the variant embodiment shown in FIG. 2, this disposition is not essential. The orifice 13 may have the same cross-section as the channel 11, or it may be smaller in section. A spray nozzle (not shown) could optionally be fitted thereto.

Figure 3:
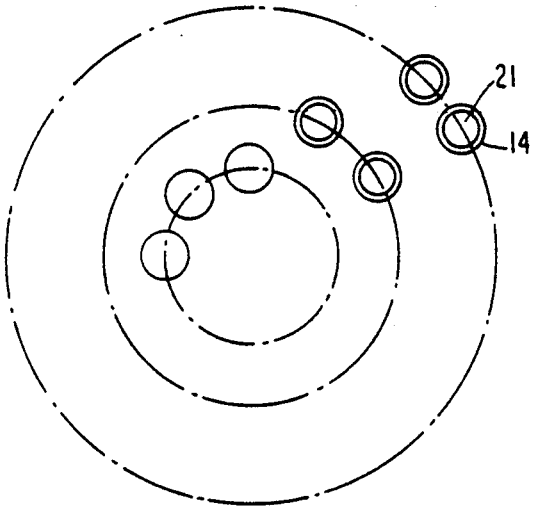
FIG. 3 is a diagram showing how the supply-containing chambers and the supplies contained therein may be disposed around the axis of the pushbutton.
Figure 4:
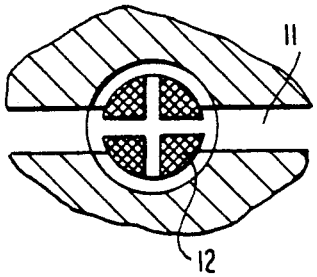
FIG. 4 is a detail plan view of the emission channel showing a cylindrical hole containing a punch.

Cylindrical holes 14 are formed in the top portion of the support 1. The axes of these holes are likewise vertical and are at a common distance from the axis of the support 1. In addition the holes are disposed uniformly around the circle defined in this way, such that for a given cross-section, the number of holes depends on the radius of the circle. FIG. 3 shows how they could be distributed in a horizontal plane. Three possible configurations are indicated eight holes on an inner circle, twelve holes on an intermediate circle, and twenty-four holes on an outer circle. Finally, the axis of one of the holes intersects the axis of the emission channel 11. The corresponding hole is deep enough to communicate with the channel. A punch 12 is engaged in the bottom of said hole so that the tip of the punch lies above the emission channel. A liquid or a powder thus passes from the hole into the channel via a plurality of vertical slots formed in the punch. The horizontal section of FIG. 4 shows greater detail of one particular embodiment of the intersection between the channel 11 and a hole.

Figure 1B:
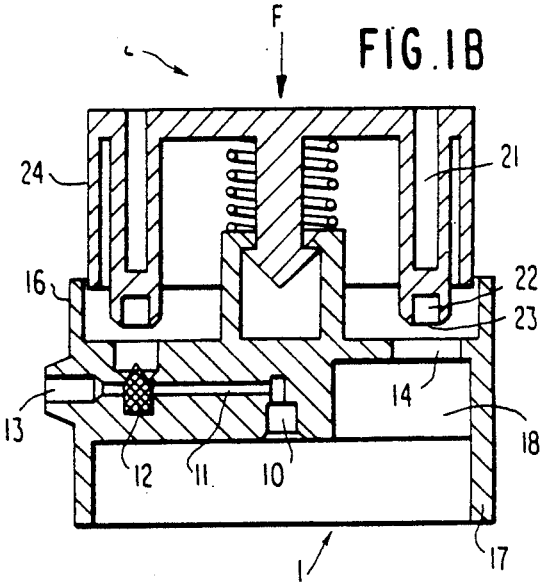

A rod 15 coaxial with the support 1 protects above the top surface of the support. It is terminated by a cone having a shoulder giving it a somewhat mushroom-shaped appearance. As shown more clearly in FIG. 2, it could be constituted by a pair of resilient plastic tongues that move horizontally away from each other whenever they are not pressed together. Thus, the rod 15 is suitable for snap-fastening in an opening having chamfered edges and a cross-section which is smaller than the cross-section of the shoulder on the rod, without there being any subsequent possibility of the items being pulled apart. This property is used to mount the revolver-type cylinder 2 in non-reversible manner on the support 1 by engaging the rod 15 in a cylindrical guide 25 on the cylinder 2. Clearly the same result could be obtained if the rod 15 were part of the cylinder 2 and the guide 25 were part of the support 1 as is shown in FIG. 1B. In addition to providing a connection between the support and the cylinder, the rod 15 also serves to enable these two items to rotate relative to each other about their common vertical axis. That is why the rod 15 is referred to below as a rotary shaft.

Although the top face of the cylinder 2 is plane, its bottom face has a plurality of vertical axis supply-containing chambers 21 in addition to its cylindrical guide 25. The common cross-section of the chambers is slightly smaller than the cross-section of the holes in the support 1 so as to enable the chambers to slide without excessive friction therein while nevertheless providing good sealing at the chamber/hole interface. The number and disposition of the chambers around the axis of the cylinder 2 is generally identical to the number and disposition of the holes around the axis of the support. However, it would be possible in this configuration for one or more of the chambers to be omitted. The extent to which the chambers are hollow depends on the quantity of secondary product to be stored in the container 22 at the bottom end of each of them. The bottom ends of the containers are closed by weak membranes 23, e.g. films of plastic material welded to the walls of the chambers 2.

A lightly compressed spring 3 wound round the rotary shaft 15 extends between the support 1 and the cylinder 2 One end of the spring bears against the top face of the support 1 while its other end bears against the cylindrical guide 25 of the cylinder 2. The spring thus keeps the cylinder 2 at a sufficient distance from the support 1 to keep the chambers 21 out of the holes 14. In this rest position, the embodiments of FIGS. 1 and 2 both provide for the top ring 16 of the support 1 to be in contact with the outside ring 24 of the cylinder 2 which is of slightly smaller diameter The pushbutton of the invention is then presented in a more agreeable compact configuration and additional protection is provided for the doses of secondary substance.

When a vertical force F is exerted on the top of the cylinder, two phenomena take place simultaneously. Firstly, the valve of the spray device is pushed in by the recess 10. The primary substance contained in the receptacle of the spray device (not shown) engages in the emission channel 11 and escapes via the orifice 13. Secondly, the spring 3 is compressed to a greater extent. The chambers penetrate into the holes providing they are in alignment. This is made possible by vertical guidance formed on the rotary shaft 15 and, optionally, on the inside ring 16 of the support 1; however the cylinder 2 may also be positioned about the axis of the support 1 either manuallY or automatically by means of teeth and notches (not shown in the figures). The punch then bursts through the membrane 23 of the full chamber level with the emission channel 11. The quantity of secondary substance contained therein flows under gravity between the slots in the punch into the channel 11 and is entrained together with the primary substance towards the orifice 13.

It may be observed that only the hole in communication with the emission channel 11 must necessarily be cylindrical and have a cross-section which is a particularly good match with the cross-section of the chambers 21 in order to ensure that no substance is emitted between the chamber and the hole. As for the other holes, they may be of any desired section and they may even run into one another so as to form one or more common cut-outs For industrial manufacturing purposes, both the supports 1 and the cylinders 2 of the present invention are preferably each molded as respective single pieces. These pieces may include partitions 18 and 26 dividing their bottom surfaces into sectors, with the chambers 21 and the holes 14 lying halfway between said partitions. The punch 12 may either be integrally molded with the support 1 or else it may be placed therein subsequently If it is put into place subsequently, it can then be made of a harder plastic material In order to make utilization of this pushbutton and mixer assembly more reliable, a device may be provided to ensure that only one full chamber engages the punch during emission and that no further main substance can be emitted after all of the chambers have been emptied. This can be done by means of a tooth disposed on the outside ring 24 of the cylinder 2 in such a manner as to be capable of moving in one direction only over a rack fixed on the top ring 16 of the support 1, said rack including an abutment The tooth can move from one notch of the rack to the next, for example, each time the force F is released and the spring expands.

In addition to being used for mixing two liquids or a powder and a liquid, a pushbutton in accordance with the invention may also be used, advantageously, for mounting on a spray device containing an inert gas under pressure such as nitrogen, $CO_2$, or freon. When the spray device is actuated, the gas released is then used for vigorously entraining the liquid or powder contained in the container 22. This is one way of obtaining finely divided emission (particles having a diameter of about one micron) as required for applying some medicines, in particular those for calming bronchial irritation.

I claim:

1. A pushbutton for fitting to a spray device containing a primary substance, said pushbutton including an emission channel, the pushbutton comprising first and second pieces, said first piece being moveably mounted relative to said second piece, said second piece containing said emission channel, said first piece of said pushbutton including containers each containing a predetermined quantity of a secondary substance and hermetically closed by individual membranes, said pushbutton further including resilient means for resiliently urging said first piece away from said second piece, said second piece including means for piercing the membrane of one of the containers when said pushbutton is actuated, the corresponding predetermined quantity of secondary substance being delivered into said emission channel.

2. A pushbutton according to claim 1, wherein said primary substance comprises a liquid solvent and said secondary substance consists of one of a liquid solute and a powder solute.

3. A pushbutton according to claim 1, wherein said primary substance comprises a propellant gas.

4. A pushbutton according to claim 1, said pushbutton being in the form of a vertical axis cylinder and said emission channel being horizontal, wherein:

(a) said piercing means comprises a punch, a support having said emission channel formed inside the bottom portion thereof, and including vertical holes in its top face, with at least one of said holes being cylindrical and centered on said emission channel such that an axis of said at least one of said holes intersects an axis of said emission channel, said at least one of said holes being in communication with said emission channel via slots provided through said punch having a tip lying on the axis of said hole and being upwardly directed; and wherein (b) said first piece comprises a revolver-type cylinder fitted to said support and having a horizontal top face sized to receive finger pressure, said first piece having said containers formed in its bottom portion with each of said containers being located in a vertical supply-containing chamber at a common distance from the axis of said pushbutton, said chambers being shaped to enter and leave each of said holes in said support without excessive friction, and each having a common cross-section corresponding in a sealed manner to the cross-section of said cylindrical hole which is centered on said emission channel, said membranes closing the bottom ends of respective ones of said chambers.

5. A pushbutton according to claim 4, wherein two of said slots in said punch are provided vertically therein, at right angles om the axis of said punch, with one of the slots being parallel to the axis of said emission channel.

6. A pushbutton according to claim 4, wherein said support includes an upper ring around a periphery thereof, said cylinder includes an outer ring of slightly different diameter from said upper ring, said upper and outer rings sliding telescopically over one another during spraying but remaining in contact when the pushbutton is at rest.

7. A pushbutton according to claim 4. wherein the supply-containing chambers include a solid portion or partition separating off a predetermined volume occupied by one of said containers.

8. A pushbutton according to claim 4, wherein said support and said cylinder are each molded as a single respective piece of plastic material.

9. A pushbutton according to claim 4, wherein said punch comprises a plastic piece which is harder than that of said support, and which is received in said support after being molded.

10. A pushbutton according to claim 4, wherein said membranes comprise plastic films welded to the walls of said supply-containing chambers.

11. A pushbutton according to claim 4, wherein said engagement means comprise a rotary shaft having the same axis as said pushbutton and cylindrical guide means, likewise having the same axis as said pushbutton, for receiving the rotary shaft in non-reversible manner and for being vertically guided in rotation thereby, one of said rotary shaft and said cylindrical guide projecting from the top face of said support and the other one thereof projecting from the bottom face of said cylinder.

12. A pushbutton according to claim 11, wherein said rotary shaft is terminated by a cone with a shoulder, and said cylindrical guide means includes chamfered end edges enabling said first and second pieces to be snap-fastened together but preventing them from being subsequently taken apart.

13. A pushbutton according to claim 11, wherein the rotary shaft comprises two tongues of resilient plastic material tending to move horizontally away from each other unless pressed together.

14. A pushbutton according to claim 11, wherein said resilient means are constituted by a spring which is wound around said rotary shaft and which is under light compression, said spring bearing at one end against the top face of said support and at its other end against said cylinder.

15. A pushbutton according to claim 4, wherein the horizontal sections of all of the holes are identical to the horizontal section of said hole centered on the emission channel, and wherein there are as many cylindrical holes as there are supply-containing chambers disposed regularly around a horizontal circle centered on the axis of said pushbutton.

16. A pushbutton according to claim 15, wherein six said holes and chambers are provided.

17. A pushbutton according to claim 15, wherein twelve of said holes and chambers are provided.

18. A pushbutton according to claim 15, wherein twenty-four of said holes and chambers are provided.

19. A spray device comprising:

a container containing a primary substance;

a metering valve connected to said container; and a pushbutton fitted over said metering valve, said pushbutton including an emission channel, and further comprising:

first and second pieces, said first piece being moveably mounted relative to said second piece, said second piece containing said emission channel, said first piece of said pushbutton including containers each containing a predetermined quantity of a secondary substance and hermetically closed by individual membranes, said pushbutton further including resilient means for resiliently urging said first piece away from said second piece, said second piece including means for piercing the membrane of one of the containers when said pushbutton is actuated, and the corresponding predetermined quantity of secondary substance being delivered into said emission channel.

* * * * *